United States Patent [19]

Holton

[11] 4,186,981

[45] Feb. 5, 1980

[54] GROUNDING DEVICE

[75] Inventor: Robert J. Holton, North Caldwell, N.J.

[73] Assignee: Eaton Corporation, Cleveland, Ohio

[21] Appl. No.: 930,969

[22] Filed: Aug. 4, 1978

[51] Int. Cl.[2] ..... H01R 3/04

[52] U.S. Cl. ..... 339/14 R; 339/244 R; 339/258 R

[58] Field of Search ..... 339/14 R, 14 L, 95 R, 339/97 R, 97 P, 98, 99 R, 119 R, 244 R, 258 R, 258 T

[56] References Cited

U.S. PATENT DOCUMENTS

| | | | |
|---|---|---|---|
| 2,636,067 | 4/1953 | Kraft | 339/258 R |
| 3,004,095 | 10/1961 | Buzak | 174/51 |
| 3,492,625 | 1/1970 | Bromberg | 339/14 |
| 3,528,050 | 9/1970 | Hindenburg | 339/95 R |
| 3,617,611 | 11/1971 | Kuether | 339/14 R |
| 3,627,900 | 12/1971 | Robinson | 339/14 R |
| 3,680,031 | 7/1972 | Schumacher | 339/14 R |
| 3,728,468 | 4/1973 | Grauer | 339/14 R |
| 4,029,384 | 6/1977 | Reinwall, Jr. | 339/98 |

FOREIGN PATENT DOCUMENTS

| | | | |
|---|---|---|---|
| 1640630 | 10/1969 | Fed. Rep. of Germany | 339/97 R |
| 1436699 | 3/1966 | France | 339/119 R |

*Primary Examiner*—Joseph H. McGlynn
*Attorney, Agent, or Firm*—R. J. McCloskey; H. D. Gordon

[57] ABSTRACT

The disclosure is directed to a grounding device of the type employed for mounting an electrical component, such as a ground wire or the like, to a panel. The device is of a one-piece, unitary construction including a base member with an integral spring-arm member formed by a pair of leg portions connected at an apex. The leg portions include a retention slot for receipt of the component and then an edge of the panel for mounting the component in substantially parallel relationship in respect to such panel edge. In another aspect, the base member includes an upstanding flange portion having an opening disposed remote from the slot for receipt of the component and then such panel edge at a point spaced laterally of the spring-arm member.

7 Claims, 5 Drawing Figures

GROUNDING DEVICE

BACKGROUND OF THE INVENTION

The present invention is directed to electric circuit establishing connections, and more particularly to a grounding device of a one-piece, unitary clip-like construction of the type for mounting an electrical component, such as a ground wire or the like, in substantially parallel relationship in respect to a confronting edge of a panel.

In general, the present invention is directed to the field of grounding circuit connections. Such grounding circuits are generally required in order to provide a grounding path to protect the user of any electrical equipment which might short circuit so as to divert any shorted current to ground to avoid injury to the user. Heretofore, it has been required that grounding continuity must be established, for example, between a grounded outlet box and a grounding circuit of an electrical receptacle by means of a jumper wire or pigtail between the outlet box and the receptacle grounding terminal. As an alternative, it has also been required that contact devices or yokes may be used in conjunction with the threaded supporting screws of the receptacle so as to establish a grounding circuit between the yoke and the outlet box of the type conventionally installed in a wall. In these prior grounding circuit connections, it has been known to utilize a grounding screw for grounding the electrical wiring systems. In other instances, various types of spring-clip devices have been employed in utilization with the terminal screw, ground strap and/or electrical receptacle or box to provide the ground connection. Typical of such prior clip devices are illustrated in U.S. Pat. Nos. 3,004,095; 3,492,625; 3,617,611; 3,627,900 and 3,680,031 and 3,728,468.

SUMMARY OF THE INVENTION

The present invention relates to the provision of a grounding device in the form of a one-piece, unitary spring-like clip for mounting an electrical component, such as a ground wire or the like, to a panel. The device comprises a base member with an integral spring-arm member formed by a pair of leg portions connected at an apex. The leg portions include a retention slot formed in the respective leg portions for receipt of the electrical component and then a confronting edge of the panel for mounting the electrical component in substantially parallel relationship in respect to such edge of the panel. In another aspect, the base member includes an integral, upstanding flange portion having an opening disposed remote from said slot for receipt of the electrical component and such panel edge and at a point spaced laterally of said spring-arm member. By this arrangement, the electrical component is held in a positive gripping engagement at multiple contact points by the grounding device for maintaining a substantially parallel attachment of the electrical component (ground wire) with a confronting edge of the panel. Hence, there is provided an efficient mechanical and electrical connection for maintaining a positive and stable contact of the electrical component (ground wire) to the panel. Further, the construction and arrangement of the grounding device provides a circuit establishing system which enables the electrical component (ground wire) to be constantly urged into electrical contact with the confronting edge of the panel. In addition, the grounding device of the invention is of a simple, yet rugged construction which is easy to fabricate and install. Further, there is provided a device which gives a three-point contact to maximize a positive electrical contact. More specifically, the device of the invention applies a slight indentation to the wire to prevent the same from slipping thereby to give the positive ground.

BRIEF DESCRIPTION OF THE DRAWINGS

FIG. 1 is a generally perspective view illustrating the grounding device of the present invention adapted for mounting an electrical connection to a panel or the like;

DESCRIPTION OF THE PREFERRED EMBODIMENTS

Figure 1:
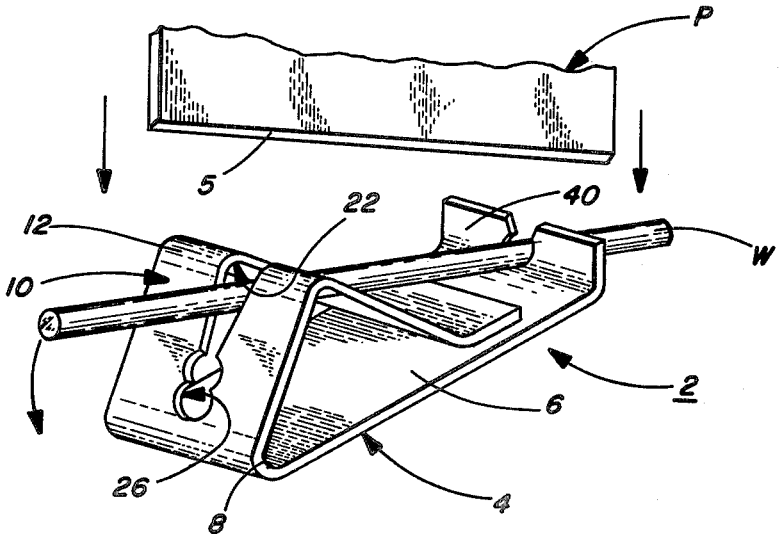

Referring again to the drawings, and in particular to FIG. 1, there is illustrated the grounding device, designated generally at 2, of the present invention for mounting an electrical connection, such as a metal conduit or ground wire W (bare) to a panel P or the like to be grounded. As shown, the device 2 includes a generally clip-like body 4 made of spring steel or the like. The body 4 is constructed and arranged for mounting the ground wire W in generally parallel relationship in respect to the confronting edge, as at 5, of the panel P. In a preferred form, the thickness of the panel is approximately equal to the diameter of the wire W.

Figure 2:
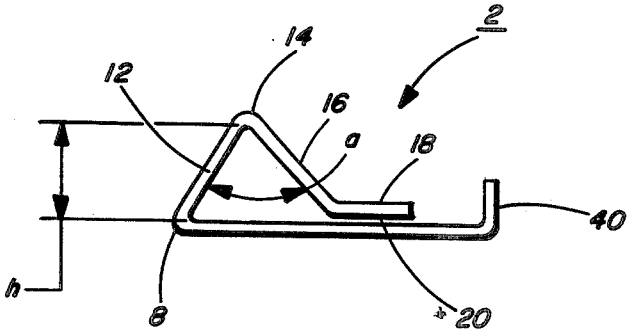
FIG. 2 is a front elevation view, on a reduced scale, of the grounding device of FIG. 1.
Figure 3:
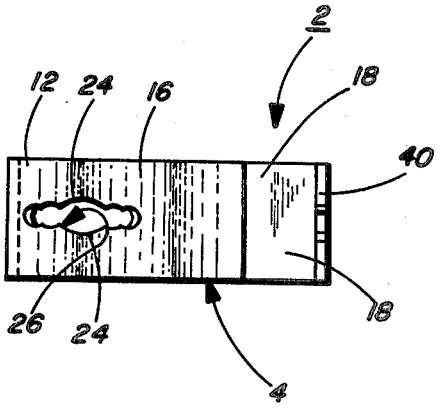
FIG. 3 is a top plan view of the grounding device illustrated in FIG. 2.

Turning now to FIGS. 2 through 5, the body 4 comprises a flat base portion 6 connected via a curved bight portion 8 to a generally triangularly shaped (in side elevation), spring-arm member 10. As shown, the spring-arm member 10 includes a first inclined leg portion 12 connected via another bight portion 14 to a second inclined leg portion 16 which together define an apex angle (a) at the bight portion 14, as seen in FIG. 2. The apex angle (a) is preferably in the range between $\frac{1}{4}$ and 5/16 inch. The preferred angle is 60°.

The leg portion 16 terminates adjacent its free end in an integral, outwardly extending flange portion 18. The flange portion 18 preferably extends generally parallel to the base portion 6 and is spaced laterally therefrom, as at 20, to provide resiliency in the spring-arm member 10. By this arrangement, the arm member 10 may be pivoted about the fulcrum point 8 (bight) so that the flange portion 18 acts as an abutment to limit movement (clockwise, FIG. 2) of the arm member 10 relative to the base portion 6. Also, the flange portion 18 extends horizontally to provide further support for the wire W which engages the same for increased or decreased conductivity, or desired.

In the invention, the leg portions 12 and 16 of the spring-arm member 10 are provided with an entry slot, designated generally at 22. The slot 22 may be characterized as a double-key-way configuration with the mid-portion disposed generally at the apex-bight portion 14 which interconnects the leg portions 12 and 16. Hence, the slot 22 has an identical or symmetric structural configuration in each leg portion 12 and 16 so that the following description may proceed with reference to one of the leg portions (12) wherein like parts are identified by like reference characters.

As shown, the slot 22 in the leg portion 12 provides an entry opening of a generally inverted, frustum shaped configuration defined by converging side edges 24 (FIG. 4) which open onto a generally figure-eight shaped opening 26. The opening 26 is defined by interconnecting, generally elliptical opening portions 28 and 30 (FIG. 4) which are defined at their respective mid-portions by oppositely disposed pointed edges 32 and 34. The edges 32 and 34 are preferably spaced apart a distance (laterally) slightly greater than the diameter (maximum) of the ground wire W, whereas, the distance between the terminal ends 36 and 38 of the inclined edges 24 is less than the diameter (maximum) of the ground wire W. By this arrangement, upon insertion of the ground wire W through the entry opening 22, the edges 24 provide cam-like surfaces which are laterally moved apart upon movement of the maximum transverse dimension of the ground wire W past the terminal ends 36 and 38. As this transverse dimension of the ground wire W passes beyond the edges 36 and 38, the wire W enters the portion 28 and then enters the portion 30 so as to be bottomed therein. In this bottomed position, the ground wire W is firmly held in place by frictional engagement with the edges 32 and 34 which coact with the curved surface, as at 39, of the portion 30 to positively hold the wire W in surface-to-surface contact therein. Accordingly, as the spring-arm member 10 has this specific configuration in each of the legs 12 and 16, there is provided a dual holding and locking action on the grounding wire W at laterally spaced points via the lateral seat provided by the axial aligned bottom openings 30 provided in each of the leg portions 12 and 16.

It is to be understood, however, that the distance between the edges 32, 34 can be greater, or less than the distance between edges 36 and 38. By this arrangement, it is possible to assemble over the end of the wire W, or insert the wire through the spring-arm, as desired.

The entry slot 22 provides a tapered access for receipt of the ground wire W and the panel P. Hence, it is preferred that the maximum width of the slot 22 be greater at the outer end than the maximum transverse thickness of the panel, whereas, the distance between the terminal end edges 36 and 38 of the slot (FIGS. 4 and 5) is slightly less than the transverse thickness of the wire and the panel. By this arrangement, as the panel P is inserted down and through the entry slot 22, the terminal end edges 36 and 38 tend to cam apart so to accommodate the wire and panel thickness, whereupon, after the panel is fully inserted, it is gripped by the edges 36 and 38 in each of the leg portions 12 and 16 so as to provide a four-point gripping and holding action on the panel with the wire being secured against the curved surfaces 39, as aforesaid. This acts to cause a slight indentation in the wire via surfaces 39 which gives a positive electrical contact.

Figure 4:
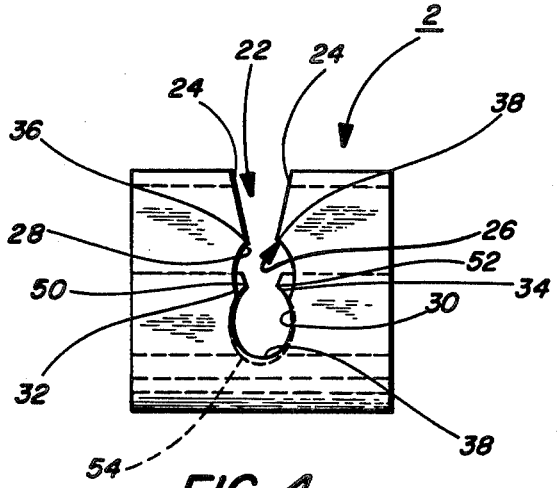
FIG. 4 is an end view, on an enlarged scale looking from the lefthand side of FIG. 3.
Figure 5:
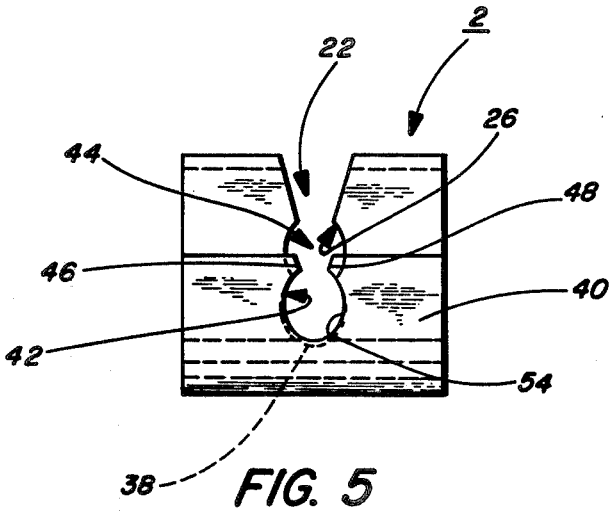
FIG. 5 is an end view, on an enlarged scale, looking from the righthand side of FIG. 3.

The base portion 6 may be provided at the end opposite the spring-arm member 10 with an integral, upstanding flange portion 40. As best seen in FIG. 2, the flange portion 40 is disposed generally at right angles to the base portion 6 and has a height which is approximately ½ the altitude or height (h) of the generally triangular configuration defined by the leg portions 12 and 16 of the spring-arm 10. As best seen in FIG. 5, an opening 42 is provided in the flange portion 40 and in substantially axial alignment with the lower opening 30 in the respective leg portions 12 and 16. This entry opening is defined by convergent side surfaces 46 and 48 which terminate in a pair of oppositely disposed terminal end edges 50 and 52 (FIG. 4), which edges are disposed substantially in axial alignment with the edges 32 and 34 defined between the open portions 28 and 30 in the respective leg portions 12 and 16, as aforesaid. The opening 42 has a similar generally elliptical shape disposed in substantially axial alignment with the corresponding openings 26 and 30 of the spring-arm member 10. As seen in FIGS. 4 and 5, the opening 42 has a curved bottom surface 54 which is in substantially axial alignment with the bottom surfaces 39 of the open portions 26 and 30. The transverse dimension between the edges 50 and 52 is preferably less than the corresponding transverse thickness of the ground wire W and the support member or panel P. Here again, the distance may be less or greater to enable the wire to be inserted, or aforesaid. Also, the tapered sides 46 and 48 provide a cam or wedging action to accommodate sliding movement of the ground wire W and/or panel P upon installation thereof.

As best seen in FIGS. 2, 4 and 5, the upper surface of the flange portion 18 of the spring-arm member 10 is preferably disposed so that its general plane extends substantially through the lowermost portion of the curved surfaces 39 (FIG. 4) and 54 (FIG. 5) of the respective openings 30 and 42 so as to provide further support for the ground wire W in the installed position. By this arrangement, the ground wire is supported in generally parallel relationship with the flange portion 18 via its bottomed position in the openings 30 and 42 in the spring-arm member 10 and in the flange portion 40. This provides a three-point gripping contact with the wire W in the installed condition thereof. Further the openings apply a slight indentation to the wire, as aforesaid.

In a typical operation, the ground wire W is simply disposed in a cradled relationship via the slot 22 in the spring-arm member 10 and the opening 42 in the flange portion 40, as best seen in FIG. 1. Thus assembled, the support member, or panel P, is slidably inserted over the ground wire W so as to drive the ground wire W in a direction toward the base portion 6. This action, via a cam-like movement, widens the slot 22 so as to force the transverse thickness of the ground wire W past the edges 36 and 38 in the leg portions 12 and 16 such that the ground wire W can be bottomed in the lowermost openings 30. Thus, bottomed, the slot 22 tends to return to its original configuration due to the spring characteristics of the metal which acts to bring the edges 36 and 38 into a firm gripping engagement with the confronting surfaces of the panel P. Thus installed, the ground wire W is disposed in general parallel relationship with the base portion 6 and, hence, with the confronting edge 5 of the panel P. As will be seen, the capability of the flange portion 18 to move relative to the base portion 6 enables the spring-arm member 10 to have a cantilever action by reason of its connection via the bight portion 8 which provides a fulcrum for pivotal movement of the spring-arm member 10 about an axis disposed at a right angle in respect to the longitudinal axis of the ground wire W. By this arrangement, the spring-arm member 10 acts to maintain a constant resilient biasing action in a direction away from the base portion 6 so as to maintain a tight gripping engagement with the ground wire W and hence, with the panel P to provide a substantially continuous electrical connection between the panel and the ground wire W in the installed condition thereof.

I claim:

1. A grounding device for mounting an electrical element, such as a ground wire or the like, to a support member comprising a body having a base member, a resilient spring-arm integral with and extending outwardly from said base member, said spring-arm including a first inclined leg portion made integral with and extending angularly outwardly from one end of said base member and a second inclined leg portion made integral with and extending angularly inwardly from said first leg portion, said spring-arm having a slot disposed in said leg portions adapted for slidably receiving said electrical element and support member therein, and said spring-arm having projection means extending into said slot adapted for gripping engagement with the confronting surfaces of said support member for holding said electrical element in substantially aligned relation with a confronting edge of said support member in the installed position thereof, said second leg portion including an integral generally laterally extending flange portion, and said laterally extending flange portion being spaced from said base member and adapted for abutting movement toward and away from said base member upon mounting of said electrical element with said support member.

2. A grounding device in accordance with claim 1, wherein said first and second leg portions together define a generally triangular configuration, in side elevation, defined by an apex angle disposed remote from said base member.

3. A grounding device in accordance with claim 1, wherein said projection means includes at least one pair of oppositely disposed terminal edges extending laterally into said slot, and said edges being laterally spaced apart by a transverse dimension which is less than the corresponding transverse thickness of said support member.

4. A grounding device in accordance with claim 3, wherein said transverse dimension between said edges is less than the corresponding transverse thickness of said electrical element.

5. A grounding device in accordance with claim 1, wherein said base member includes an integral upstanding flange portion disposed at the end opposite said spring-arm, and said flange portion including an opening adapted to receive said electrical element and said support member therein.

6. A grounding device in accordance with claim 5, wherein said upstanding flange portion includes projection means extending into said opening adapted for gripping engagement with said support member upon insertion of said electrical element into said openings.

7. A grounding device in accordance with claim 5, wherein said spring-arm and upstanding flange portion together define a three-point gripping contact for said electrical element.

* * * * *